US005780820A

United States Patent [19]

Komyoji et al.

[11] Patent Number: 5,780,820

[45] Date of Patent: Jul. 14, 1998

[54] FILM-LIKE HEATER MADE OF HIGH CRYSTALLINE GRAPHITE FILM

[75] Inventors: Daido Komyoji, Ikoma; Takao Inoue, Hirakata; Naomi Nishiki, Kyoto; Junji Ikeda, Ikoma, all of Japan

[73] Assignee: Matsushita Electric Industrial Co., Ltd., Osaka, Japan

[21] Appl. No.: 612,176

[22] Filed: Mar. 7, 1996

[30] Foreign Application Priority Data

Mar. 8, 1995 [JP] Japan ..... 7-048443

[51] Int. Cl.[6] ..... H05B 3/20

[52] U.S. Cl. ..... 219/543; 219/549; 219/385; 219/217; 392/389

[58] Field of Search ..... 219/528, 543, 219/548–549, 385, 217; 338/210–212, 280, 283, 292–293; 392/389

[56] References Cited

U.S. PATENT DOCUMENTS

| | | | |
|---|---|---|---|
| 1,881,444 | 10/1932 | Flanzer | 219/543 |
| 2,682,483 | 6/1954 | Erbe | 219/549 |
| 2,803,566 | 8/1957 | Smith-Johannsen | 219/543 |
| 3,553,834 | 1/1971 | Olstowski et al. | 219/529 |
| 4,149,066 | 4/1979 | Niibe | 219/528 |
| 4,560,428 | 12/1985 | Sherrick et al. | 338/212 |
| 4,626,644 | 12/1986 | Grise | 338/211 |
| 4,749,844 | 6/1988 | Grise | 219/528 |
| 5,149,470 | 9/1992 | Suda | 264/29.6 |
| 5,229,582 | 7/1993 | Graham | 219/528 |
| 5,309,135 | 5/1994 | Langford | 338/211 |
| 5,422,622 | 6/1995 | Sakamoto | 338/210 |

FOREIGN PATENT DOCUMENTS

| | | |
|---|---|---|
| 123540 | 10/1984 | European Pat. Off. . |
| 346088 | 12/1989 | European Pat. Off. . |
| 304683 | 12/1989 | Japan . |
| 304684 | 12/1989 | Japan . |
| 8258 | 1/1990 | Japan . |
| 170859 | 7/1990 | Japan . |
| 181566 | 8/1991 | Japan . |
| 21508 | 1/1992 | Japan . |
| 353391 | 12/1992 | Japan . |

*Primary Examiner*—John A. Jeffrey
*Attorney, Agent, or Firm*—Wenderoth, Lind & Ponack, L.L.P.

[57] ABSTRACT

A film-like heater which has a graphite film made of a polymer film baked at a temperature higher than 2,000 ° C. and having a good thermal conductivity, a good flexibility and a good resistance to high temperature, so that it is applicable to a thin face heat-retaining or heating means having various designs such as a seat heater fittable to a body shape, a vapor deposition boat operable at a high temperature and a compact heating device or apparatus.

14 Claims, 4 Drawing Sheets

FILM-LIKE HEATER MADE OF HIGH CRYSTALLINE GRAPHITE FILM

BACKGROUND OF THE INVENTION

1. Field of the Invention

The present invention relates generally to a film-like heater applicable to a thin face heat-retaining or heating means having various designs such as a seat heater fittable to a body shape, a vapor deposition boat operable at a hightemperature and a compact heating device or apparatus.

2. Description of Related Art

Instead of NICHROME (a ferrous alloy containing nickel and chromium) wires and ceramic materials used as a heating element, there has been proposed a graphite material to compose a thin type heater. Generally, however, the graphite material is difficult to be applied to where it is subject to repeated bending, because the conventional graphite material has no flexibility and especially if a thinner graphite material would be used to improve heat efficiency, resultant heaters in many cases would not be practical because of brittleness. Further, since the conventional graphite material is not flexibly deformable in case of fitting to a body shape, it is difficult to make a heat-retaining seat with a sufficient performance. Furthermore, although high temperature evaporation from 2000° C. to 3000° C. will be required in the vapor deposition boat, it is difficult to heat the conventional graphite up to such a high temperature because of less resistance to heat. In many cases, anyway, more compact and effective heaters have been required.

SUMMARY OF THE INVENTION

The present invention has been developed to overcome the above-described disadvantages.

It is accordingly a first objective of the present invention to provide a thin and flexible film-like heater which is suitably used in a field wherein the heater is subjected to repeated bending.

A second objective of the present invention is to provide a film-like heater used for a seat which is heat-retainable and fittable to a body shape.

A third objective of the present invention is to provide a film-like heater used for a vapor deposition boat operable at a high temperature.

A fourth objective of the present invention is to provide a film-like heater used for a more compact and effective heating furnace.

In accomplishing the above and other objectives, it has been found that: 1) a high crystals graphite film in which graphite crystals are oriented in a face extending direction has a good thermal conductivity to an extent of 200 to 1,000 Kcal/m·hr·° C. in the face extending direction and the thermal conductivity is substantially unchanged in greater or lesser degrees of the film thickness, so that the high crystals graphite film is suitable to compose a thin film-like heater.

Further, it has been also found that: 2) the high crystals graphite film has a good flexibility to an extent of 0.5 to 20° with respect to Rocking characteristic and a good resistance to repeated bending to an extent of resisting the 90° bending test at least 5 times as well as the above characteristic, so that the high crystals graphite film is suitable to compose a seat heat-retainable and fittable to a body shape because of resistance to repeated bending.

Furthermore, it has been also found that: 3) the high crystals graphite film has a good resistance to high temperature as well as the above characteristics, so that the high crystals graphite film is suitable to compose a vapor deposition boat operable at a high temperature from 2000° C. to 3000° C.

Therefore, according to a first aspect of the present invention, there is provided a film-like heater which comprises a thin face heating element made of a high crystals graphite film in which graphite crystals are oriented in a face extending direction, having a good thermal conductivity in the face extending direction which is substantially unchanged in greater or lesser degrees of the film thickness and a good flexibility to an extent of less than 20° with respect to Rocking characteristic, and a means for supplying current to said heating element.

The high crystals graphite film can be prepared by graphitizing methods disclosed in Japanese Tokkaihei 3-75211 and 4-21508, in which a specific polymer film such as polyimide and polyamide, is subjected to a heat treatment in an inert atmosphere at a temperature more than 2400° C. and if necessary further to a roll treatment. The resultant graphite film has a uniformly foamed structure due to the high temperature heating treatment and a flexible and elastic characteristic due to the roll treatment. The graphite crystals is oriented in the face extending direction, so that the thermal conductivity is substantially unchanged in greater or lesser degrees of the film thickness, resulting in a light material having a good heat conductivity to an extent of 200 to 1,000 Kcal/m·hr·° C. and a good resistance to heat.

The high crystals graphite film having a flexibility to an extent of less than 20°, preferably 0.5 to 20° with respect to Rocking characteristic is preferred. The graphite film can be prepared by a graphitizing process comprising steps of heat treating the polymer film at above 2000° C. in the inert gas atmosphere and roll treating the same. Further, it can be prepared by another graphitizing method comprising a step of heat treating the polymer film at above 2400° C. in the inert gas atmosphere. The Rocking characteristic can be measured at a peak position of graphite (0002) line by means of Rotorflex RU-200 B type X-ray diffraction apparatus.

The specific polymer film may be selected from the group consisting of polyoxadiazoles (POD), polybenzothiazoles (PBT), polybenzobisthiazoles (PBBT), polybenzooxazoles (PBO), polybenz bisoxazoles (PBBO), polyimides (PI), polyamide (PA), polyphenylene-imidazoles (PPBI), polythiazoles (PT) and polyphenylene-vinylenes (PPV).

The polyoxadiazoles include polyparaphenylene-1,3,4-oxadiazole and its isomers.

The polyimides include aromatic polyimides represented by the following formula (I):

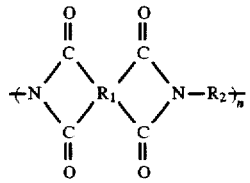

(I)

Wherein $R_1$ =

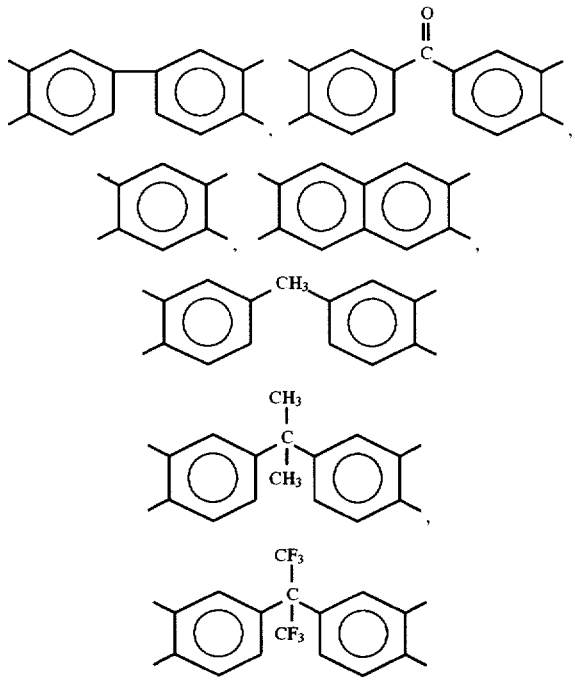

$R_2$ =

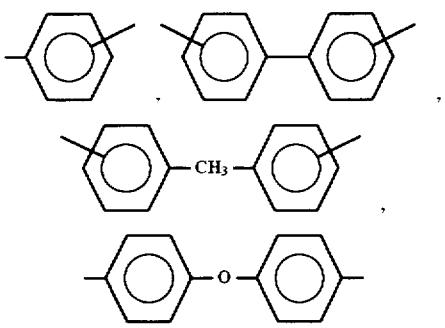

The polyamides include aromatic polyamides represented by the following formula (II):

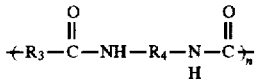

(II)

Wherein

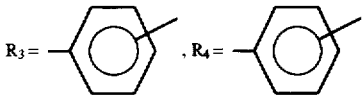

The polyimides and polyamides to be used in the present invention are not limited to the above structures.

The polymer films may contain fillers such as inorganic and organic ones, which are selected from the group consisting of phosphate compounds, calcium phosphate compounds, polyester compounds, epoxy compounds, stearic acid compounds, trimellitic acid compounds, metal oxide compounds, organic tin compounds, lead compounds, azo-compounds and sulfonyl-hydrazide compounds.

The optimum amount of the fillers may be determined depending on the film thickness. In case of a thicker polymer film, a larger amount of the fillers may be better while in case of a thinner polymer film, a smaller amount of the fillers may be better. Generally, the amount of the fillers is preferably from 0.2 to 20% by weight and more preferably from 1 to 10% by weight.

The fillers make a resulting polymer film after the heat treatment to which is in a uniformly foamed state as follows. That is, the fillers subjected to the heat treatment generate gases, which make through holes for passing decomposed gases smoothly therethrough, resulting in the uniformly foamed structure.

The heat treatment for graphitizing the polymer film containing the fillers may be carried out at a temperature of more than 2,400° C., preferably about 3,000° C., because a higher oriented graphite crystals can be obtained while in case of less than 2,000° C. a resultant graphite film tends to be hard and brittle. The heat treatment may be carried out in an inert gas atmosphere. In order to avoid the effect of gases generated during the graphitizing step, the thickness of the polymer film to be graphatized may be preferably more than 5 μm. The heat treatment may be carried out at a normal pressure. The polymer film to be graphatized should be cut into a suitable size and placed into a balking furnace to be heated to more than 2,400° C. for graphitizing. If necessary, the resultant graphite film may be subjected to a roll treatment after the heat treatment.

Among the resultant graphite films, especially in case of using aromatic polyimides as a starting polymer film, it is found that the graphite film has the following characteristics.

Specific gravity: 0.5–1.5

Heat conductivity: 860 kcal/m·h·° C. (=2.5×Cu, 4.4×Al) (AB face direction)

Electric conductivity: 250,000 S/cm (AB face direction)

Elastic modulus: 84,300 kgf/mm $^2$ (AB face direction)

Therefore, according to the present invention there is provided a film-like heater having much more flexibility in comparison to the conventional graphite heater, so that the film-like heater according to the present invention is suitable for use where the heater is subjected to a repeated bending operation without damage. In comparison to the conventional graphite sheet, it is easy for the graphite film according to the present invention to be made much thinner, so that the heater according to the present invention has a better heat efficiency than the conventional ones. Further, the heater according to the present invention has a low voltage electric power generation efficiency due to a low resistance and thus needs a lower source capacity. The heat efficiency can be improved due to far infrared rays radiated from the film-like heater according to the present invention. The heater according to the present invention can be made in a desired shape because of simple cutting of the graphite film.

The preferred graphite film has a thickness of 5 to 200 μm, because of good flexing deformability and good heat efficiency. If the thickness is beyond 200 μm, the flexibility lowers. It is difficult to prepare film of less than 5 μm in thick.

The graphite film may be coated on at least one surface by a covering sheet material. The coated graphite film can be protected from damage and reinforced. In case of the covering sheet made of an insulating material, the conductive heat element made of the graphite material can be insulated electrically. On the other hand, in case of the covering sheet made of heat-retaining material, the heat retaining efficiency of the heater can be improved. The covering sheet may have an opening or openings through which a portion or portions of said heating element are exposed to discharge heat from said heating element. Therefore, a temperature profile at the surface of the heater can be controlled by the number and the position of the openings.

The film heater may be used for a heat-retaining seat, in which the film-like heater is arranged at surfaces of the seat, so the seat surface can be heat-retained effectively and can be deformed flexibly according to the body shape of the user with the result that the user feels comfortable.

The film heater may be used for a concave surface for receiving an evaporating material in a vapor deposition boat, because of the good heat efficiency and the simple formability of the graphite film as well as the good resistance to heat in a vacuum at a temperature from 2,000° C. to 3,000° C. Especially, a graphite film having a thickness of 5 to 200 μm can fully achieve the above functions.

The film heater may also be used for a wall of a heating furnace, resulting in compact size and good heat efficiency of the heating furnace.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

DETAILED DESCRIPTION OF THE PREFERRED EMBODIMENTS

EXAMPLE 1

Figure 1:
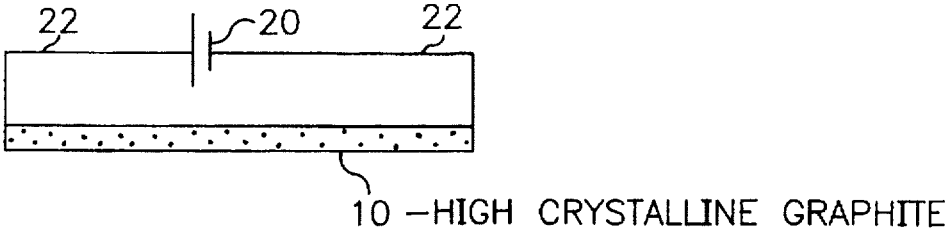
FIG. 1 is a schematic view showing a simple embodiment of the film-like heater according to the present invention.

FIG. 1 shows a film-like heater which comprises a heating element 10 made of a high crystals graphite film, both ends being connected to a DC source 20 through wirings 22, 22 with a switching device (not drawn).

The high crystals graphite 10 is made from a polyimide (Capton H film: made by Dupont Co.) having a thickness of about 25 μm. The graphite film 10 has a high crystals orientation in a face extending direction with the Rocking characteristic of less than 20°.

The film-like heater can be integrated into various kinds of apparatuses and structural elements. The graphite film 10 can be designed in various shapes and arranged on in optional position.

EXAMPLE 2

Figure 2A:
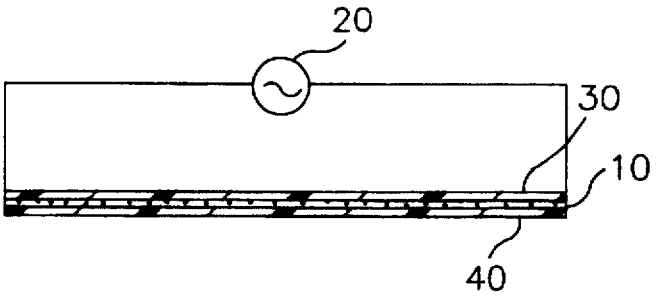
FIG. 2A is a schematic view showing a second embodiment of the film-like heater according to the present invention.
Figure 2B:
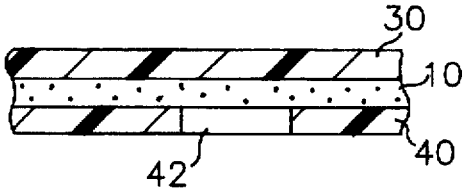
FIG. 2B is an enlarged part view of FIG. 2A.

FIG. 2A shows a film-like heater which comprises a heating element 10 made of the graphite film used in Example 1 and a pair of covering film sheets 30 and 40 coated on both faces of the heating element 10, one covering film sheet 30 made of polyimide resin being coated on one whole side face of the heating element 10 while the other covering film sheet 40 is coated on an opposite side face with some openings 42 as shown in FIG. 2B.

Figure 3:
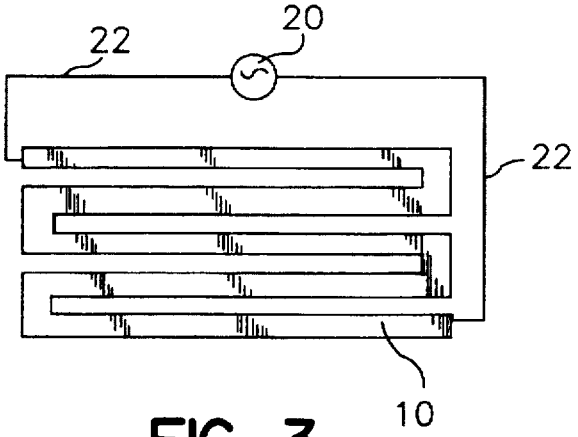
FIG. 3 is a plane view showing a third embodiment of the film-like heater according to the present invention.
Figure 4:
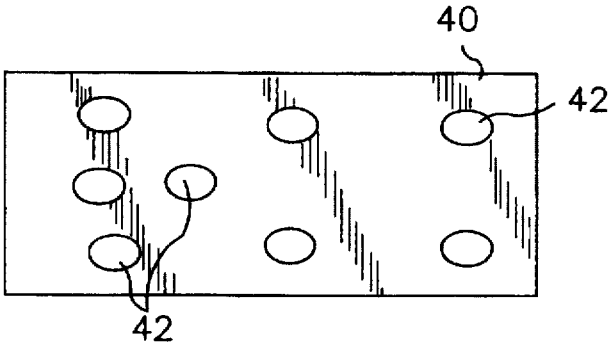
FIG. 4 is a plane view showing a fourth embodiment of the film-like heater coated by a covering sheet according to the present invention.

FIG. 3 shows another film-like heater which comprises belt-like heating elements arranged in a zig-zag pattern and wirings 22 and 22 of an electric source 20 connected to both ends of the heating elements. The heating elements are prepared by cutting the graphite film into a belt shape and coating them with covering sheets 40 with some openings 42 as shown in FIG. 4.

In those cases, the heating elements 10 are protected by the covering sheets 30 and 40, for example, and are also insulated by the covering sheets 30 and 40.

The covering sheets 30 and 40 can control heat radiating from the heating elements 10. That is, the covering sheets 30 and 40 act to block the heat radiating from the heating elements while the openings thereon help to radiate concentrated the heat blocked by the covering sheets to outside, resulting in such a heat distribution that the openings have a larger quantity of heat than the other parts. The heat distribution pattern can be controlled by the number and the position of the openings.

In case of FIG. 2B, the opening side of the heating elements should be positioned toward a place required to be heated. If different heating pattern on the covering sheet side 30 and the covering sheet side 40 is required, it should be realized by controlling the thickness of the covering sheets 30 and 40.

The film-like heater can be integrated into an automobile seat as a surfacing sheet material. In this case, either of the covering sheets 30 and 40 may be used as the surfacing sheet and a built-in battery may be used as the electric source for the heater.

EXAMPLE 3

Figure 5:
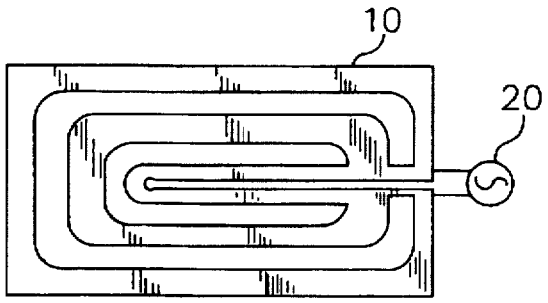
FIG. 5 is a plane view showing a fifth embodiment of the film-like heater according to the present invention.

FIG. 5 shows another film-like heater having a different plane pattern from that of FIG. 3. In this case, a heat distribution pattern can be changed according to the plane pattern of the heating elements 10.

Figure 6:
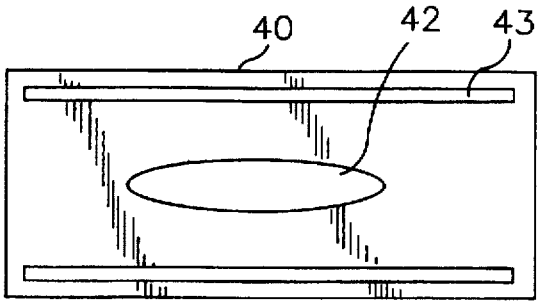
FIG. 6 is a plane view showing a sixth embodiment of the film-like heater coated by a covering sheet according to the present invention.

FIG. 6 shows a covering sheet 40 suitable to be stacked o the heating element shown in FIG. 5. The covering sheet has a long elliptic opening 42 at the center and long groove openings 43 near both edges.

EXAMPLE 4

Figure 7:
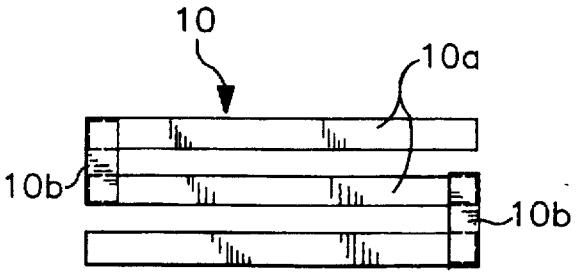
FIG. 7 is a plane view showing a seventh embodiment of the film-like heater according to the present invention.

FIG. 7 shows a strip combination type heating element 10 composed of long and short high crystals graphite strips **10*a* and 10*b*** which are connected respectively with their ends to be in a S shape as a whole.

EXAMPLE 5

Figure 8:
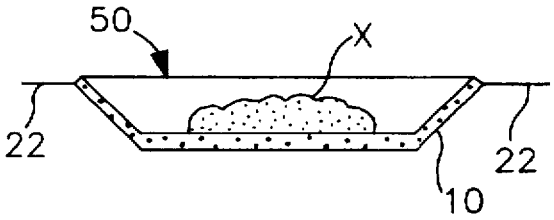
FIG. 8 is a plane view showing a vapor deposition boat according to the present invention.

FIG. 8 shows a vapor deposition boat 50 having a dish-like concave recess which is made from the high crystals graphite by molding fabrication and on the outer periphery of which wirings 22 and 22 are arranged to supply current to the boat 50.

A vapor deposition can be carried out by heating an evaporation material X received in the boat 50 in a vacuum vapor deposition apparatus. The boat 50 can be heated to about 3,000° C.

EXAMPLE 6

Figure 9:
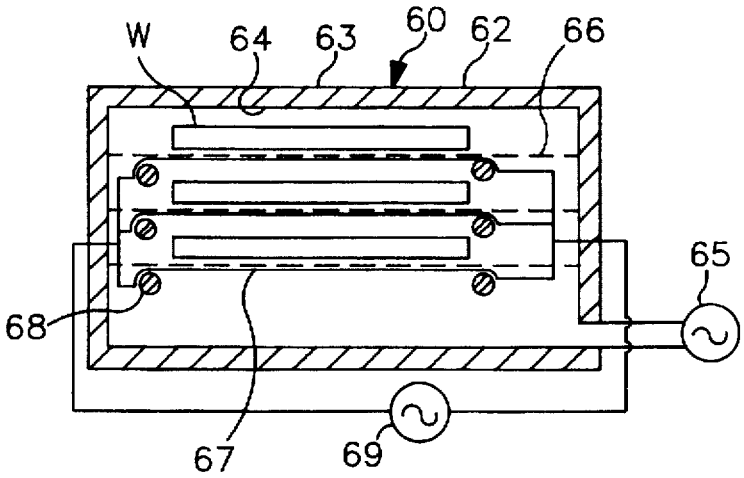
FIG. 9 is a plane view showing a heating furnace according to the present invention.

FIG. 9 shows a heating furnace 60 having a heat treating room 62 for receiving a material to be heated, which room is composed by heat insulating walls 63 having inside face heaters 64. The face heater can be made of the film-like heater according to the present invention and is connected with an electric source 65. In the heat treating room 62, there are provided plural shelves 66 made of wire netting for putting the material to be heated thereon. Along each bottom of the shelves there are arranged middle heaters 67 which have the same construction as the above face heater 64 and are supported at both ends by supporting axes 68.The middle heaters 67 are connected to an electric source 69 out of the heat treating room.

The materials (w) to be heated are put on the shelves and can be heated from upper and lower sides and the periphery sides by the face heaters 64 and the middle heaters 67. The heaters 64 and 67 are thin and have a good heat efficiency, so that the room spaces are utilized as much as possible and the materials (w) can be heated efficiently. Especially, the thin middle heater 67 can be positioned in a narrow space between the shelves, so that the materials (w) positioned on and below the shelves 66 can be heated efficiently. The heaters 64 and 67 have a small heat capacity and thus large cooling and heating rates, resulting in good heat operating characteristics.

The film-like heater can be applied to various fields where conventional sheet-like or film-like seats heaters have been used, including a seat heater for heat-retaining seets in an automobile and airplane, heat-retaining floor coverings or mattings, a heat-retaining blanket, an heat-retaining outfit for cold weather,-heat-retaining winter clothes, a heat-retaining pillow.

The film-like heater has a resistance to high temperature, so that it can be used in a field where a high temperature heating is needed.

The covering sheet material can be selected from the group consisting of various films made of synthetic resins, metals, ceramics, woven clothes and unwoven clothes. The covering sheet 30 without openings and the covering sheet 40 with openings 42 may be used to coat one side or both sides of the heating element 10. The covering sheets 30 and 40 may be overlapped in some cases. Although the covering sheets 3C and 40 are generally flexible, the thickness of the covering sheets are changeable in order to control the heating characteristics.

The shape of the film-like heater is changeable according to the application. It is easy to cut the graphite film heating element 10 into an optional shape, so that the film-like heater is producible for in-place use.

The electric supply means 20 can be designed freely with respect to the kind of electric sources and wiring systems. Examples of the electric sources include a DC source such as dry cells and batteries and a commercial AC source which are applicable to various purposes. The high crystals graphite film 10 can generate heat effectively by means of a low voltage and low current, so that a small capacity source such as solar cells can be used as the electric source of the film-like heater according to the present invention.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being-included therein.

What is claimed is:

1. A film heater which comprises:

(a) at least one thin face heating element made of a crystalline graphite film, having a thickness of 5 to 200 μm in which graphite crystals are oriented in a direction extending parallel to the film surface, having in said direction a thermal conductivity substantially unchanged in greater or lesser degrees of the film thickness and a flexibility, based on the orientation of the graphite crystals of less than 20° with respect to Rocking characteristic, and (b) a current supply coupled to said heating element.

2. The film-like heater according to claim 1, wherein said heating element is coated on at least one surface thereof by covering sheet materials.

3. The film-like heater according to claim 2, wherein said covering sheet material is an insulated material.

4. The film-like heater according to claim 2, wherein said covering sheet material is a heat-retaining material.

5. The film-like heater according to claim 2, wherein said covering sheet material has an opening or openings through which a portion or portions of said heating element are exposed to discharge heat through the opening or openings from said heating element.

6. The film-like heater according to claim 1, which is incorporated as a built-in seat heater.

7. The film-like heater according to claim 1, which is incorporated as a thin wall or a thin shelf of a heating room.

8. The film heater according to claim 1, wherein the graphite film has a thermal conductivity of 200 to 1000 Kcal/m·hr·° C. in the direction extending parallel to the film surface.

9. The film heater according to claim 1, wherein the graphite film is made by graphitizing a polymer film at above 2400° C. in an inert atmosphere.

10. The film heater according to claim 9, wherein the polymer film is selected from the group consisting of polyoxadiazoles, polybenzothiazoles, polybenzobisthiazoles, polybenzooxazoles, polybenzobisoxazoles, polyimides, polyamides, polyphenylene-imidazoles, polythiazoles and polyphenylene-vinylenes.

11. A film heater which comprises:

(a) at least one thin face heating element made of a crystalline graphite film, having a thickness of 5 to 200 μm, in which graphite crystals are oriented in a direction extending parallel to the film surface, having in said direction a thermal conductivity substantially unchanged in greater or lesser degrees of the film thickness and a flexibility, based on the orientation of the graphite crystals of less than 20° with respect to Rocking characteristic, and (b) a current supply coupled to said heating element, said thin face heating element forming at least a heating concave surface of an evaporating boat for receiving an evaporation material in the concave surface.

12. The film heater according to claim 11, wherein the graphite film has a thermal conductivity of 200 to 1000 Kcal/m·hr·° C. in the direction extending parallel to the film surface.

13. The film heater according to claim 11, wherein the graphite film is made by graphitizing a polymer film at above 2400° C. in an inert atmosphere.

14. The film heater according to claim 14, wherein the polymer film is selected from the group consisting of polyoxadiazoles, polybenzothiazoles, polybenzobisthiazoles, polybenzooxazoles, polybenzobisoxazoles, polyimides, polyamides, polyphenylene-imidazoles, polythiazoles and polyphenylene-vinylenes.

* * * * *